US006157354A

United States Patent [19]

Amemiya

[11] Patent Number: 6,157,354

[45] **Date of Patent: *Dec. 5, 2000**

[54] SURFACE-DISCHARGE TYPE PLASMA DISPLAY PANEL

[75] Inventor: Kimio Amemiya, Yamanashi-ken, Japan

[73] Assignee: Pioneer Electronic Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/024,403

[22] Filed: Feb. 17, 1998

[30] Foreign Application Priority Data

Mar. 5, 1997 [JP] Japan ..... 9-067346

[51] Int. Cl.[7] ..... G09G 3/28

[52] U.S. Cl. ..... 345/60; 345/67; 315/169.4

[58] Field of Search ..... 345/60–68; 315/169.3, 315/169.4, 169.1; 313/581, 582, 585–587, 484–487

[56] References Cited

U.S. PATENT DOCUMENTS 5,086,257 2/1992 Gay et al. ..... 345/68
5,661,500 8/1997 Shinoda et al. ..... 345/60

*Primary Examiner*—Regina Liang
*Attorney, Agent, or Firm*—Arent Fox Kintner Plotkin & Kahn PLLC

[57] ABSTRACT

A surface-discharge type plasma display panel, comprises: a plurality of displaying lines each including a first maintaining electrode and a second maintaining electrode, forming a discharging gap therebetween; and a dielectric layer covering the first and second maintaining electrodes. A mutual positional relationship between a first maintaining electrode and a second maintaining electrode is alternatively changed from one displaying line to another. Each first maintaining electrode and/or each second maintaining electrode are constructed in a manner such that two adjacent maintaining electrodes are electrically connected to each other through at least one connecting means.

4 Claims, 4 Drawing Sheets

SURFACE-DISCHARGE TYPE PLASMA DISPLAY PANEL

BACKGROUND OF THE INVENTION

The present invention relates generally to a plasma display panel, particularly to a surface-discharge type plasma display panel.

A surface-discharge type plasma display panel is formed by alternatively placing a plurality of maintaining electrodes X, Y. When such a surface-discharge plasma display panel is driven, a unit display period is divided into an address period and a sustain period. During the address period, either a selective writing address method or a selective erasing address method is used, so that wall electric charges are accumulated in discharge cells (to be lighted) successively from one displaying line to another. During the sustain period, sustain pulses are alternatively applied to maintaining electrodes X, Y on all the displaying lines, so as to effect a desired discharge emission.

However, in the above-described structure, since an electrode X and an electrode Y are situated adjacent to one another between two displaying lines, an electric potential difference occurs between two displaying lines during the sustain period. In order to prevent undesired panel discharge, it is necessary to enlarge a space between every two displaying lines. As a result, since a pitch between every two displaying lines has to be enlarged, it is difficult to obtain a plasma display panel having a compact structure with a high precision.

Recently, there have been two suggestions to solve the above-described problems.

One suggestion is an arrangement shown in FIG. 5. In FIG. 5, A denotes column electrodes (address electrodes), L denotes displaying lines corresponding to individual row electrode pairs (maintaining electrodes X,Y). As illustrated in FIG. 5, maintaining electrodes X, Y are arranged in a manner such that their mutual positional relationship are alternatively changed from one displaying line L to another.

Another suggestion is an arrangement as shown in FIG. 6. As illustrated in FIG. 6, each maintaining electrode X is positioned between two adjacent maintaining electrodes Y (such as Y1 and Y2, Y3 and Y4) being driven selectively and successively.

In the above arrangement shown in FIG. 5, since every two maintaining electrodes forming an interval space between the two electrodes, are two same electrodes X, X or two same electrodes Y, Y, there will be no electric potential difference therebetween during the sustain period. However, if an electrode X or an electrode Y is disconnected, it will become impossible to perform predetermined displaying operation. As a result, the disconnection of an electrode X or an electrode Y will reduce the efficiency of a plasma display panel when in use. Moreover, repairing the disconnected electrode has been proved to be expensive in cost.

Further, in the above arrangement shown in FIG. 6, the number of electrodes X may be reduced by half so as to form a compact plasma display panel with a high precision. However, since one electrode X is used for two adjacent displaying lines, partition walls have to be made as having a thin strip-like shape. As a result, there will be a problem that an electric discharge occurring in one discharge cell S11 will jump through the electrode X and arrive at another discharge cell S12, causing a mistaken discharge. To prevent such a mistaken discharge, it has been suggested to have partition walls arranged in a lattice-like manner. This, however, requires that the partition walls in a lattice-like arrangement be made with an extremely high precision, resulting in an increased cost in manufacturing process.

SUMMARY OF THE INVENTION

It is an object of the present invention to provide an improved plasma display panel of a surface-discharge type which has been improved in its displaying quality and in which a disconnected electrode will not stop the normal displaying performance, so as to solve the above-mentioned problems peculiar to the above-mentioned prior arts.

According to the present invention, there is provided a surface-discharge type plasma display panel, comprising: a plurality of displaying lines each including a first maintaining electrode and a second maintaining electrode, forming a discharge gap therebetween; and a dielectric layer covering the first and second maintaining electrodes. A mutual positional relationship between a first maintaining electrode and a second maintaining electrode is alternatively changed from one displaying line to another. Each first maintaining electrode receives an identical drive signal, each second maintaining electrode receives a successively selective drive signal. Further, each first maintaining electrode and/or each second maintaining electrode are constructed in a manner such that two adjacent maintaining electrodes are electrically connected to each other through at least one connection.

According to one aspect of the present invention, each first maintaining electrode and each second maintaining electrode is comprised of a transparent electrically conductive film and a metal film laminated over the transparent electrically conductive film.

According to another aspect of the present invention, each first maintaining electrode and each second maintaining electrode are arranged on an inner surface of a first substrate.

According to another aspect of the present invention, the surface-discharge type plasma display panel includes a second substrate facing the first substrate with a discharge space therebetween, and further includes a plurality of elongate stripe-like partition walls in a direction orthogonal to the first and second maintaining electrodes so as to divide the discharge space into a plurality of smaller discharging cells.

According to a further aspect of the present invention, the transparent electrically conductive film has a plurality of protruding portions, so that in each discharging cell two protruding portions are facing each other with a discharge gap therebetween.

According to a still further aspect of the present invention, the connection is comprised of a transparent electrically conductive film connecting together the transparent electrically conductive films of two adjacent maintaining electrodes.

According to a still further aspect of the present invention, the connection is comprised of a metal film connecting together the metal films of two adjacent maintaining electrodes.

According to a still further aspect of the present invention, each connection is provided in a position corresponding to a partition wall.

The above objects and features of the present invention will become more understood from the following description with reference to the accompanying drawings.

DETAILED DESCRIPTION OF THE PREFERRED EMBODIMENTS

Figure 1:
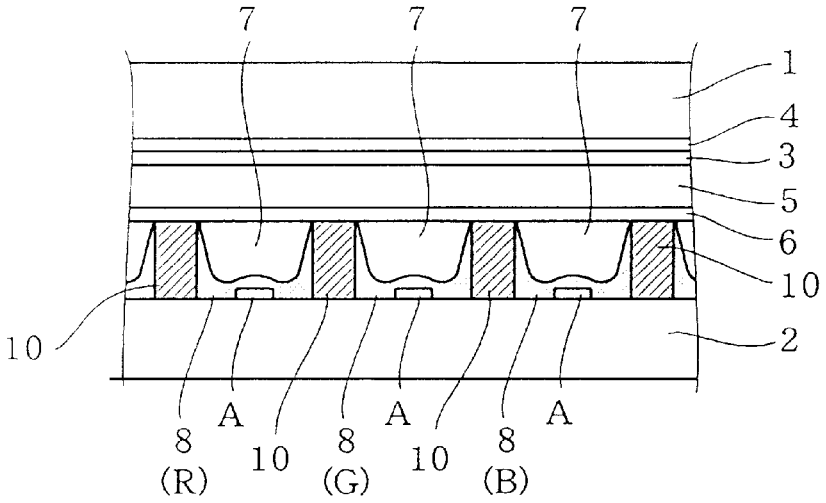
FIG. 1 is a cross sectional view schematically illustrating a surface-discharge type plasma display panel according to one embodiment of the present invention.
Figure 2:
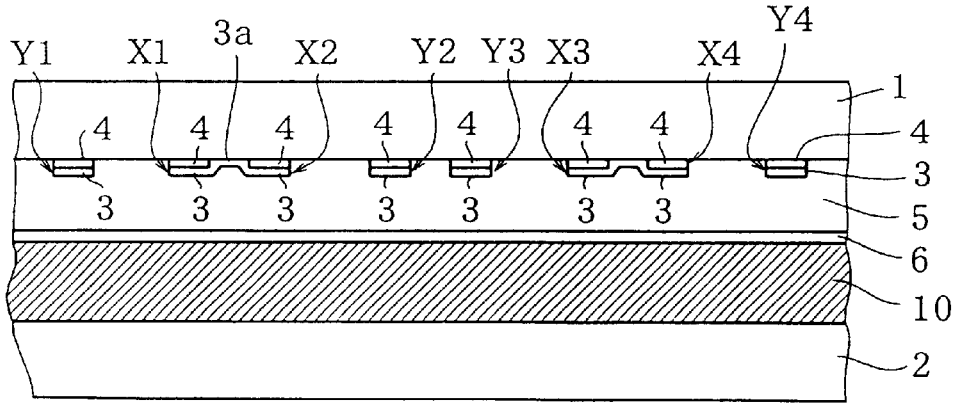
FIG. 2 is another cross sectional view schematically illustrating a surface-discharge type plasma display panel according to the same embodiment of the present invention.

A first embodiment of a plasma display panel according to the present invention will be described with reference to FIGS. 1–3. FIG. 1 is a cross sectional view illustrating the structure of the plasma display panel, along the longitudinal direction of row electrodes thereof. FIG. 2 is a cross sectional view illustrating the structure of the plasma display panel, along the longitudinal direction of partition walls thereof.

As illustrated in FIG. 1, the plasma display panel of the first embodiment has a front substrate 1 and a rear substrate 2, which are facing each other with a discharge space 7 formed therebetween.

Referring to FIGS. 1 and 2, the front substrate 1 has on its inner surface a plurality of row electrode pairs (including first maintaining electrodes X and second maintaining electrodes Y) arranged in parallel with one another. A dielectric layer 5 for producing wall charges is formed to cover the plurality of row electrode pairs (X, Y). Further, a protection layer 6 made of Mg0 is formed to protect the dielectric layer 5.

Each row electrode pair includes a first maintaining electrode X and a second maintaining electrode Y. Each of a first maintaining electrode X and a second maintaining electrode Y comprises a transparent electrode 4 including of a transparent electrically conductive film, and a bus electrode 3 (metal electrode) consisting of laminated metal layers for improving the electrical conductivity of the transparent electrode 4.

On the other hand, referring to FIGS. 1 and 2, the rear substrate 2 has on its inner surface a plurality of partition walls 10 which are arranged in a direction orthogonal to the row electrode pairs (X, Y), thereby rendering the discharge space 7 to be divided into a plurality of elongate sub-spaces. The elongate sub-spaces accommodate column electrodes A (address electrodes) arranged in a direction orthogonal to the row electrode pairs (X, Y). In addition, a fluorescent material layer 8 including three primary colours (Red, Green, Blue) is provided to cover the partition walls 10 and the column electrodes A.

Then, a discharging gas containing neon and a small amount of xenon is sealed into the discharge space 7. Thus, a plurality of discharge cells (picture elements) are formed by way of intersection of the row electrode pairs (X, Y) with the column electrodes A.

Figure 3:
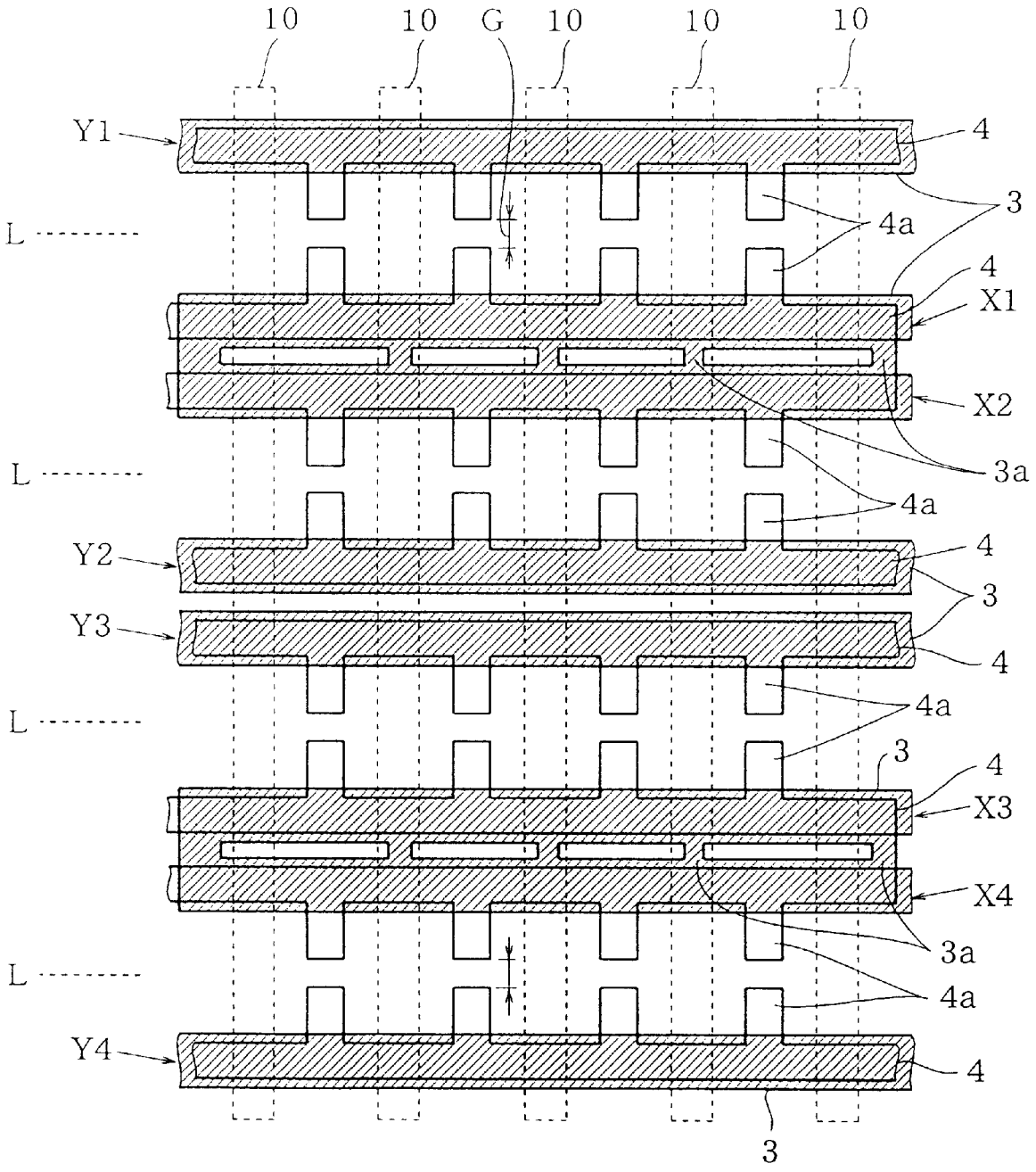
FIG. 3 is a plane view schematically illustrating an arrangement of maintaining electrodes of a surface-discharge type plasma display panel, according to one embodiment of the present invention.

FIG. 3 is a plane view illustrating an arrangement of the maintaining electrodes (X, Y) of a plasma display panel according to one embodiment of the present invention. As shown in FIG. 3, a first and a second maintaining electrodes (X, Y) which together form a row electrode pair on a displaying line L (row), have their mutual positional relationships changed alternatively from one displaying line L to another. Maintaining electrodes (for example, X1 and X2 or X3 and X4) which receive an identical drive signal, are connected to each other (in short circuit) through at least one connection 3*a*.

Further, each transparent electrode 4 partially forming a maintaining electrode pair (X, Y), as shown in FIG. 3, has a plurality of projections 4*a* each protruding towards a discharge gap G in each discharge cell, such that two projections (4*a*,4*a*) of two mutually facing transparent electrodes (4, 4) are caused to face each other with a discharge gap G therebetween.

Referring to FIG. 3, each connection 3*a* is formed of a metal film connecting together two adjacent bus electrodes 3. In fact, one or more connectors 3*a* are provided in positions corresponding to left and right ends of two adjacent bus electrodes 3 and corresponding to partition walls 10.

Therefore, with the use of the above surface-discharge type plasma display panel, during a sustain period undergoing an electric discharge, two adjacent maintaining electrodes will become short circuit in positions corresponding to partition walls 10, thus there will be not be any potential difference between the two electrodes. In this way, it is sure to avoid a mistaken discharge towards an adjacent discharge cell, so that one discharge corresponding to one picture element is prevented from spreading to other picture elements in other discharge cells.

Further, since one or more connecting means 3*a* are located in positions corresponding to left and right ends of two adjacent bus electrodes 3 and corresponding to partition walls 10, i.e., located in positions not including any picture element formation area, and since each connection 3*a* is made of a metal film, it is sure that the light emission of each picture element will not be obstructed, thereby ensuring a high efficiency for the light emission of a picture element.

With the use of the surface-discharge type plasma display panel according to this embodiment, in a sustain period during which a sustain pulse is alternatively applied to the row electrodes (X, Y) on all displaying lines L to maintain discharge emission, since two adjacent bus electrodes 3, 3 are connected to each other through a connection 3*a*, even if one electrode is disconnected, it is still possible to maintain a displaying performance on a displaying line having the disconnected electrode.

In the above-described embodiment, one or more connecting means 3*a* are formed of a metal film connecting together two adjacent bus electrodes 3, and are provided in positions corresponding to left and right ends of two adjacent bus electrodes 3 and corresponding to partition walls 10. On the other hand, if merely one connection 3*a* is provided for connecting two adjacent bus electrodes 3, when one side electrode is disconnected it is still possible to maintain a displaying performance on a displaying line having the disconnected electrode. Further, if two or more such connectors 3 are provided in the same manner, when the electrode(s) of one or both sides are disconnected it will be more exact to maintain a displaying performance on a displaying line having the disconnected electrode(s).

In this way, the first maintaining electrodes (for example, X1 and X2, X3 and X4) in which every two bus electrodes 3 are connected to each other (in short circuit) through a connection 3*a*, have provided an enlarged electrode width for each displaying line (L) as shown in FIG. 3. As a result, voltage drop may be exactly reduced, mistaken discharge may be prevented or at least reduced, thereby improving the picture quality for the plasma display panel.

On the other hand, the connecting means 3*a* may also be comprised of a transparent electrically conductive film connecting two adjacent transparent electrodes 4 of first maintaining electrodes (for example, X1 and X2, X3 and X4). In such a case, a connection 3*a* is allowed to be made of a material which is identical as the transparent electrode 4. When the connecting means 3*a* is made of a material identical as the transparent electrode 4, it will be easy for projections 4*a* of two mutually facing transparent electrodes 4 to be alined with each other, so that every two corresponding projections 4*a* are caused to face each other with a discharge gap G formed therebetween, as shown in FIG. 3.

Figure 4:
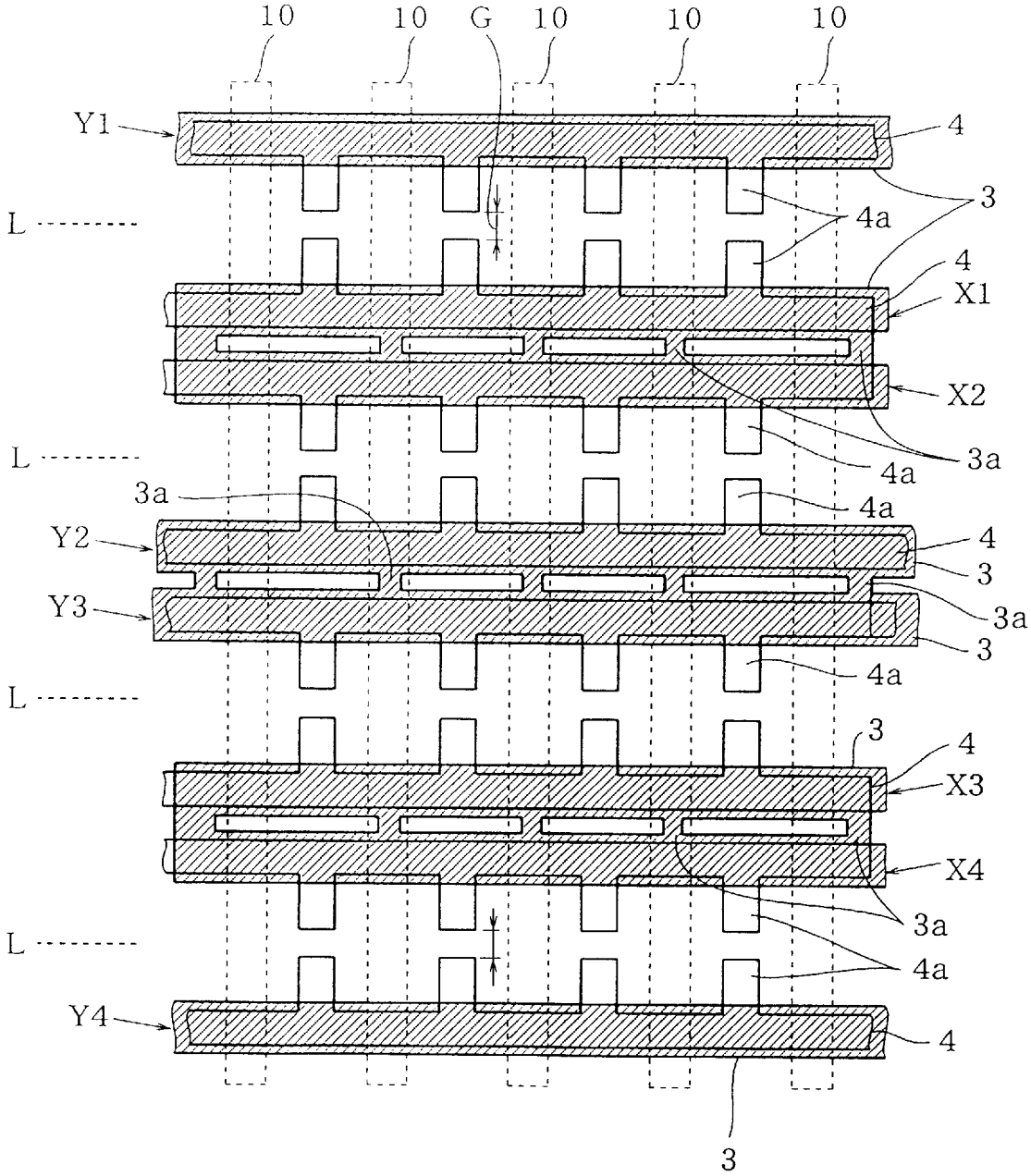
FIG. 4 is a plane view schematically illustrating an arrangement of maintaining electrodes of a surface-discharge type plasma display panel, according to another embodiment of the present invention.
Figure 5:
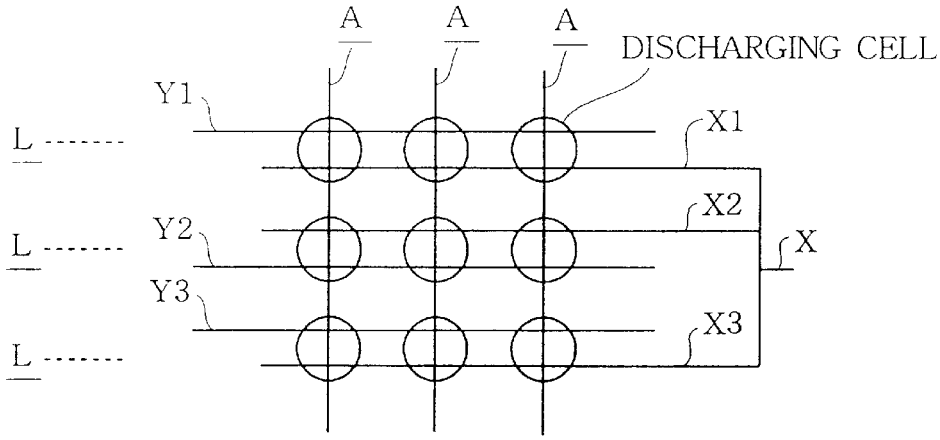
FIG.5 PRIOR ART
FIG. 5 is a plane view schematically illustrating an arrangement of maintaining electrodes of a surface-discharge type plasma display panel, according to one example of prior art.
Figure 6:
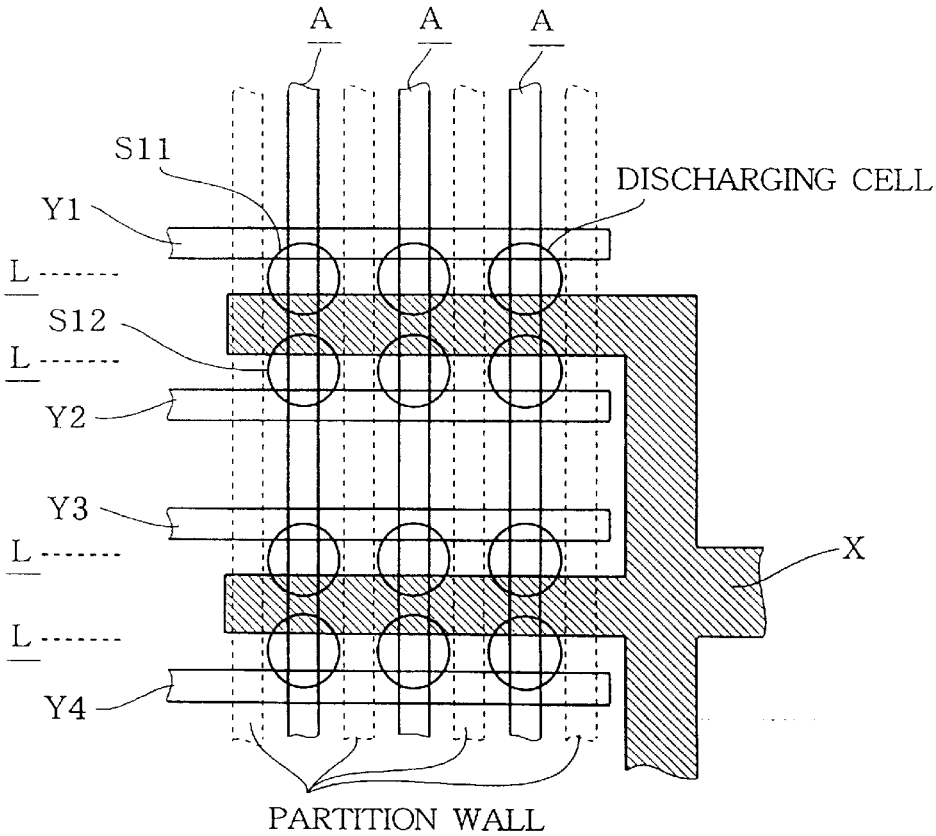
FIG.6 PRIOR ART
FIG. 6 is a plane view schematically illustrating an arrangement of maintaining electrodes of a surface-discharge type plasma display panel, according to another example of prior art.

FIG. 4 shows another embodiment of the present invention. indicating that an identical drive signal may also be supplied to two adjacent second maintaining electrodes Y (for example, Y2 and Y3). Namely, as illustrated in FIG. 4, every two adjacent bus electrodes 3 or two adjacent transparent electrodes 4 partially forming second maintaining electrodes may be electrically connected to each other through at least one connection 3*a*.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A surface-discharge type plasma display panel, comprising:

a first substrate;

a second substrate facing the first substrate with a discharge space formed therebetween;

a plurality of displaying lines each including a first maintaining electrode and a second maintaining electrode, all provided on the inner surface of the first substrate;

a dielectric layer provided on the inner surface of the first substrate so as to cover the first and second maintaining electrodes;

a plurality of address electrodes provided on the inner surface of the second substrate and arranged in a direction orthogonal to the first and second maintaining electrodes;

a plurality of elongated stripe-like partition walls arranged in a direction orthogonal to the first and second maintaining electrodes so as to divide the discharge space into a plurality of discharge cells;

wherein a mutual positional relationship between a first maintaining electrode and a second maintaining electrode is alternatively changed from one displaying line to another;

wherein two mutually adjacent maintaining electrodes of two mutually adjacent displaying lines are electrically connected to each other through a plurality of connections located in a displaying area of the plasma display panel;

wherein each of the first and second maintaining electrodes is comprised of a transparent electrically conductive film and a metal film laminated over the transparent electrically conductive film;

wherein each connection is comprised of a transparent electrically conductive film connecting together the transparent electrically conductive films of two adjacent maintaining electrodes, and wherein each connection is provided in a position corresponding to an elongated strip-like partition wall.

2. A surface-discharge type plasma display panel according to claim 1, wherein each transparent electrically conductive film has a plurality of protruding portions, in a manner such that in each discharging cell two protruding portions are facing each other with a discharge gap formed therebetween.

3. A surface-discharge type plasma display panel, comprising:

a first substrate;

a second substrate facing the first substrate with a discharge space formed therebetween;

a plurality of displaying lines each including a first maintaining electrode and a second maintaining electrode, all provided on the inner surface of the first substrate;

a dielectric layer provided on the inner surface of the first substrate so as to cover the first and second maintaining electrodes;

a plurality of address electrodes provided on the inner surface of the second substrate and arranged in a direction orthogonal to the first and second maintaining electrodes;

a plurality of elongated stripe-like partition walls arranged in a direction orthogonal to the first and second maintaining electrodes so as to divide the discharge space into a plurality of discharge cells;

wherein a mutual positional relationship between a first maintaining electrode and a second maintaining electrode is alternatively changed from one displaying line to another;

wherein two mutually adjacent maintaining electrodes of two mutually adjacent displaying lines are electrically connected to each other through a plurality of connections located in a displaying area of the plasma display panel;

wherein each of the first and second maintaining electrodes is comprised of a transparent electrically conductive film and a metal film laminated over the transparent electrically conductive film;

wherein each connection is comprised of a metal film connecting together the metal films of two adjacent maintaining electrodes;

wherein each connection is provided in a position corresponding to an elongated stripe-like partition wall.

4. A surface-discharge type plasma display panel according to claim 3, wherein each transparent electrically conductive film has a plurality of protruding portions, in a manner such that in each discharging cell two protruding portions are facing each other with a discharge gap formed therebetween.

* * * * *